US006910242B2

(12) United States Patent
Hsu

(10) Patent No.: US 6,910,242 B2
(45) Date of Patent: Jun. 28, 2005

(54) BATH BRUSH

(75) Inventor: Connie Hsu, Taipei (TW)

(73) Assignee: Mien Yao International Corp., Taipei (TW)

( * ) Notice: Subject to any disclaimer, the term of this patent is extended or adjusted under 35 U.S.C. 154(b) by 130 days.

(21) Appl. No.: 10/410,241

(22) Filed: Apr. 10, 2003

(65) Prior Publication Data

US 2004/0200022 A1 Oct. 14, 2004

(51) Int. Cl.[7] ..... A47K 7/02
(52) U.S. Cl. ..... 15/209.1; 15/229.13
(58) Field of Search ..... 15/209.1, 229.11, 15/229.13, 244.1

(56) References Cited

U.S. PATENT DOCUMENTS

| | | | | | |
|---|---|---|---|---|---|
| 781,292 | A | * | 1/1905 | Murphee | 15/110 |
| 1,498,385 | A | * | 6/1924 | Knowmall | 15/229.11 |
| 6,092,258 | A | | 7/2000 | Chen | |

* cited by examiner

*Primary Examiner*—Randall Chin
(74) *Attorney, Agent, or Firm*—Birch, Stewart, Kolasch & Birch, LLP

(57) ABSTRACT

A bath brush comprises a stem having at least one hole, at least one fastener which is mounted on the corresponding hole, and a mesh. The fastener has a hat with a hollow part and a pair of plastic parts disposed on the hat respectively. The mesh is disposed through the hollow part, and the fastener is mounted into the hole in order to secure the mesh on the stem.

20 Claims, 6 Drawing Sheets

BATH BRUSH

FIELD OF THE INVENTION

The present invention relates to a cleaning accessory, and more particularly to a bath brush having at least one mesh, each mounted on a fastener and then inserted into a stem.

BACKGROUND OF THE INVENTION

Conventionally people take a bath to clean the body generally applying soap on the wet body and rub the skin to produce bubbles and foams, then cleansing the body to wash away the bubbles. As many people perspire profusely and cannot take a bath frequently during daytime, merely resorting water and soap to clean the body is not enough. Other measures such as physical accessories must be used to scrub the skin in order to remove the sweats and dirt away. In order to achieve this purpose, mesh cloths have been developed and introduced.

Although the mesh cloth can remove the sweat and dirt from the skin by scrubbing, the single layer structure limits its capability of adsorbing soap foam and bubbles. While folding the mesh cloth can increase the adsorption capacity, it tends to get loose when in use and becomes very annoying.

Some people try to use sponges that have a stronger adsorption capacity to substitute the mesh cloths. While the sponge can adsorb more bubbles, it is often too soft and does not have effective scrubbing power.

There are other bath brushes being proposed in the prior art. For instance, U.S. Pat. No. 6,092,258 entitled "Bath brush" discloses a bath brush including an elastic mesh tube, a grip member and a binding member. Although the above bath brush can solve the aforesaid problems, however, the elastic mesh tube and the grip member are bound by binding members such as a plurality of ropes or strings to thread through the mating through holes in order to fasten the elastic mesh tube. The whole structure is complicated and difficult to fabricate.

SUMMARY OF THE INVENTION

Therefore the primary object of the invention is to resolve the aforesaid disadvantages. The invention provides a bath brush which can be easily manufactured and securely assembled by using fasteners to combine the mesh on the stem.

It is a further object of the invention to provide the above bath brush which is used comfortably by disposing the fasteners within the first trough and the second trough.

In order to achieve the object set forth above, the bath brush of the invention includes a mesh, a stem, and a plurality of fasteners for combining the mesh with the stem. The mesh is embraced by the hollow part of each fastener. The fasteners are inserted into the holes of the stem with the hats coupling with the periphery of the holes in the first trough and the plastic parts coupling with the periphery of the holes in the second trough to allow the mesh and the fasteners securely fastening to the stem.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Figures 1A, 1B:
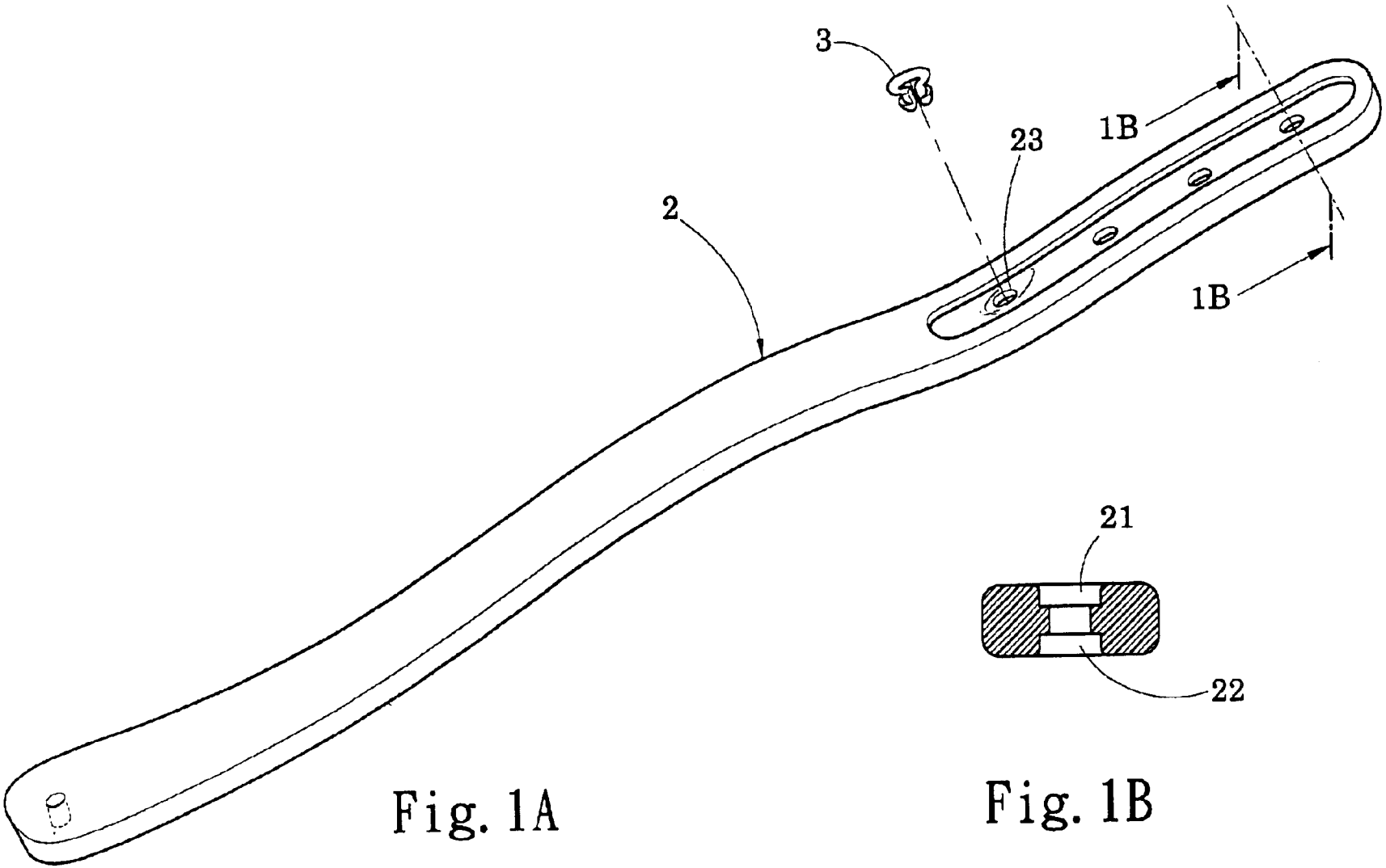
FIG. 1A is a perspective view of the stem of the invention.
FIG. 1B is a sectional view taken along line 1—1 of FIG. 1A.
Figure 2B:
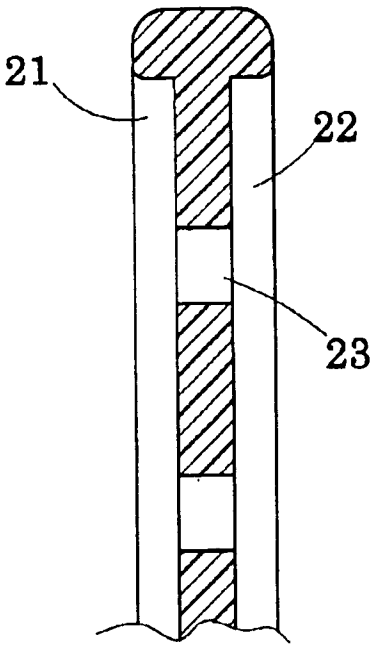
FIG. 2B is a sectional view taken along line 2—2 of FIG. 2B.
Figure 2A:
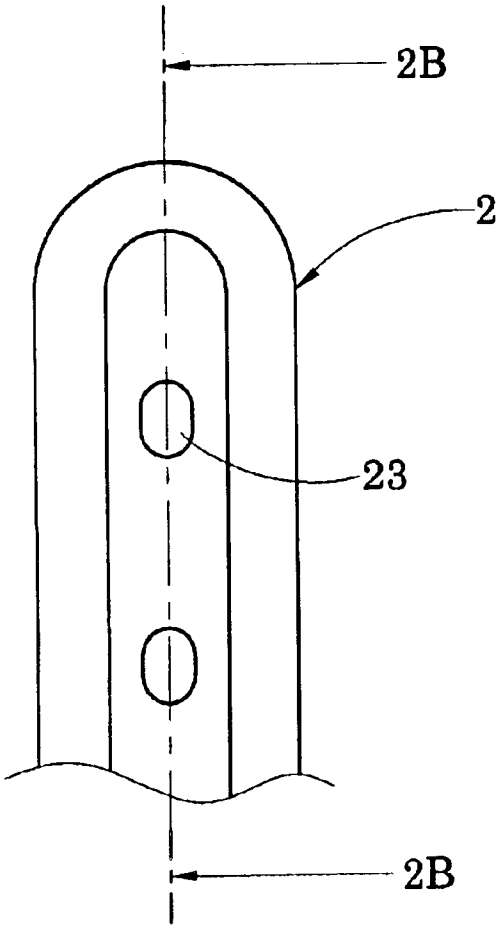
FIG. 2A is a sectional view of the stem of the invention.
Figure 3:
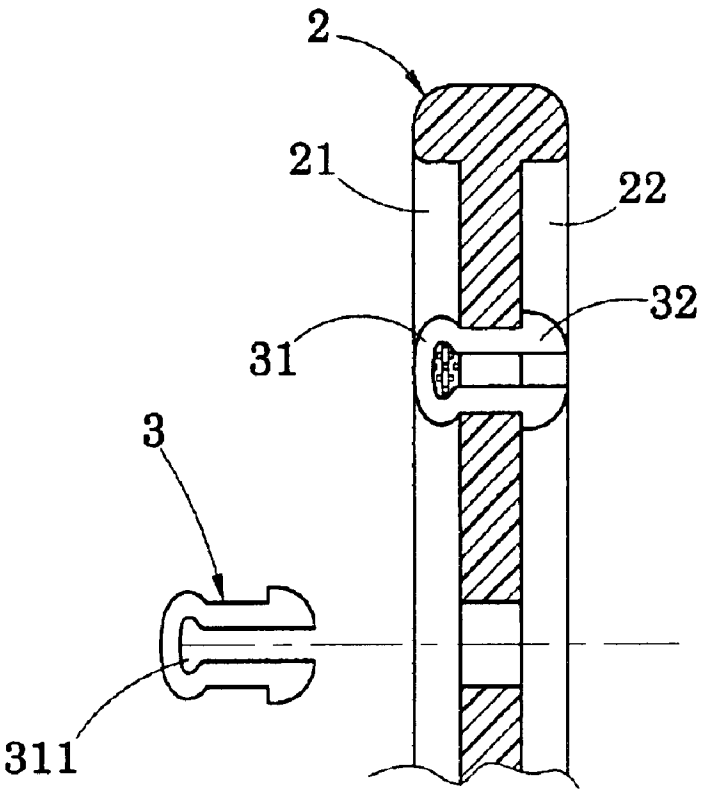
FIG. 3 is a cross section according to FIG. 2A, showing the fasteners in operation.
Figure 4B:
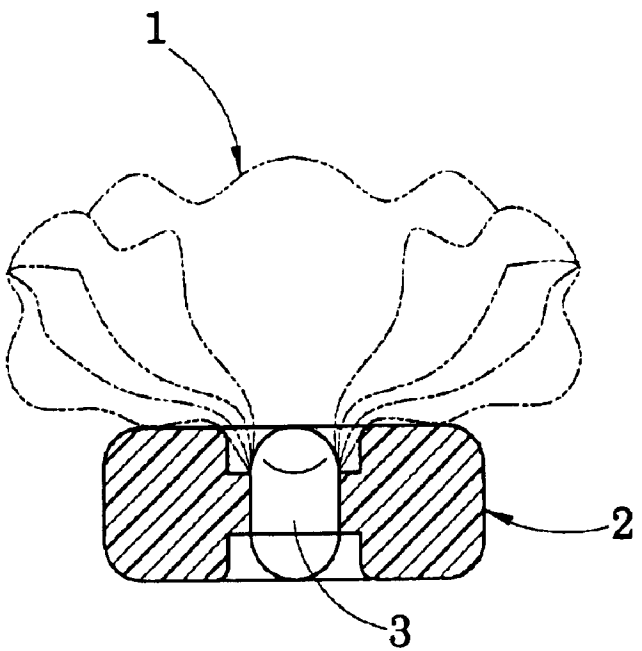
FIG. 4B is a schematic view of the invention in operation.
Figure 4A:
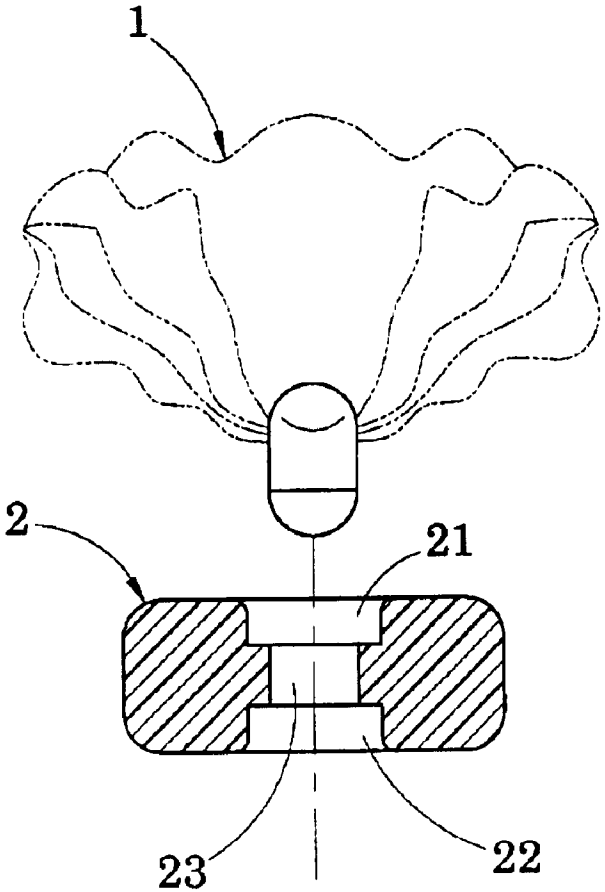
FIG. 4A is a schematic view of the invention in operation.

Referring to FIGS. 1A, 1B, 2A, and 2B, the bath brush of the present invention includes at least one mesh 1, a stem 2, and at least one fastener 3 for combining the mesh 1 with the stem 2.

The stem 2 is composed of a first trough 21 and a second trough 22, said second trough 22 is in position corresponding to the first trough 21, and at least one hole 23 being positioned within the first trough 21 and the second trough 22.

The mesh 1 is made of plastic material by integral molding. The mesh 1 has a certain length relative to the first trough 21, and is pushed and compressed to be crimped and waved.

Said fastener 3 is used to match with the corresponding hole 23, said fastener 3 having a hat 31 with a hollow part 311 and a pair of plastic parts 32 disposed on the hat 31.

Please refer to FIGS. 3, 4-1, 4-2. When to assemble the invention, put the mesh 1 across the hollow part 311 of the fastener 3. Then insert the fastener 3 into the hole 23 of the stem 2 with the hat 31 coupling with the periphery of the hole 23 in the first trough 21 and the plastic parts 32 coupling with the periphery of the hole 23 in the second trough 22 to allow the mesh 1 and the fasteners 3 fastening securely to the stem 2.

Since said fastener 3 is restrictively engaged within the first trough 21 and the second trough 22, in order to restrict the corresponding movement between the fastener 3 and the first trough 21 and the second trough 22, it would be comfortable while using the bath brush to brush the body for there is no way of the fastener 3 to scratch or to hurt the body.

Figure 5:
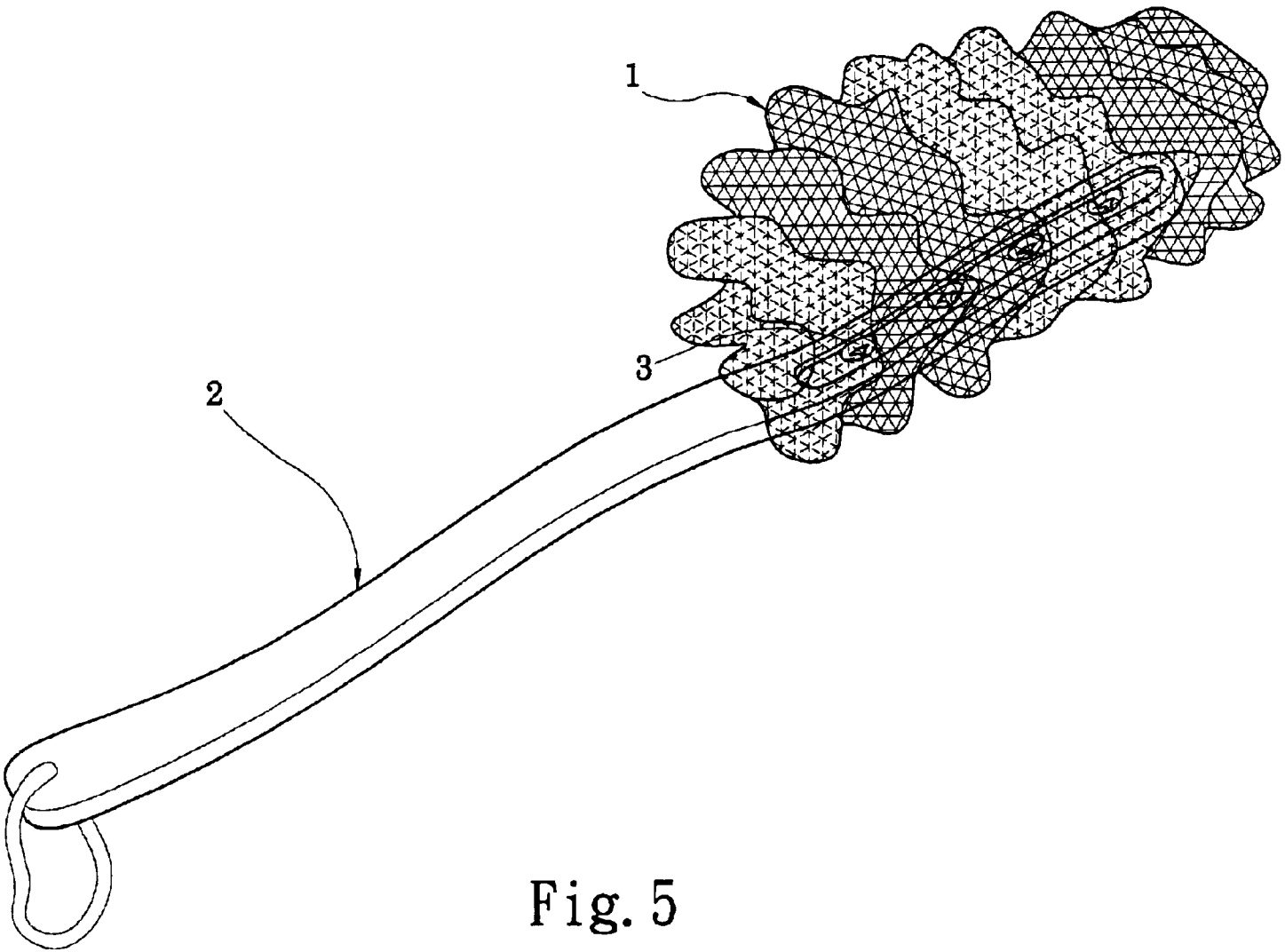
FIG. 5 is a perspective view of the invention.

Please further refer to FIG. 5, the stem 2 contains plurality of holes 23 which allow several mesh 1 each mounted on the fastener 3, to be inserted therein, so that user can use this design to scratch large cleaning area.

Figure 6:
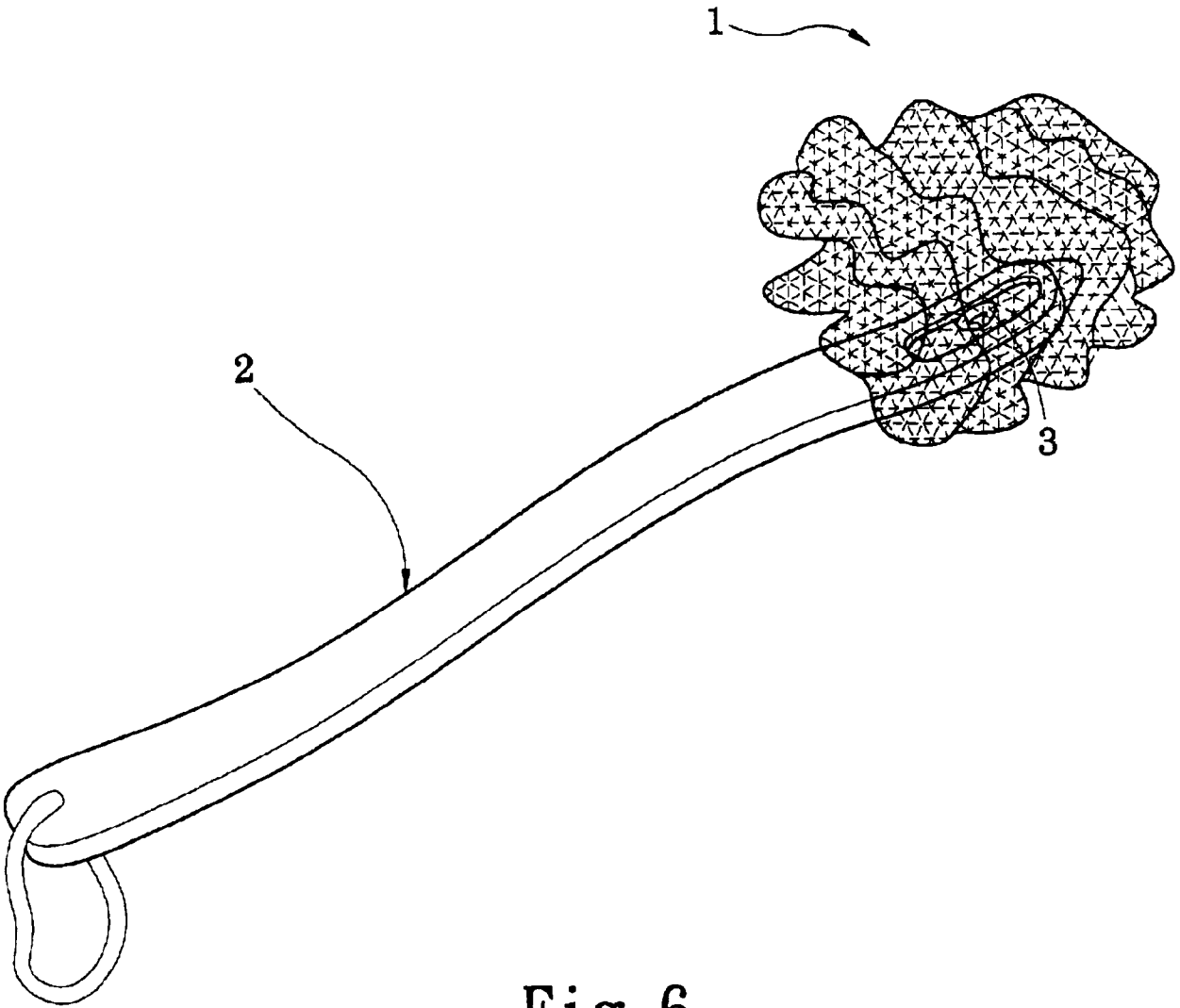
FIG. 6 is another perspective view of the invention.

Please further refer to FIG. 6, the stem 2 contains only one hole 23 which allows one mesh 1 to be mounted by inserting one fastener 3 therein, so as to provide a relatively smaller bath brush for cleaning narrow parts of the body.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bath brush comprising:

a stem having at least one hole on a longitudinal side of said stem;

at least one fastener corresponding to the at least one hole, including a hat with a hollow part and a pair of plastic parts disposed on the hat; and at least one mesh disposed on the stem by passing through the hollow part of the fastener and then inserting the fastener into the at least one hole of the stem.

2. The bath brush of claim 1, wherein the stem has a first trough and a second trough corresponding to the first trough.

3. The bath brush of claim 2, wherein the at least one hole is positioned within the first trough and the second trough.

4. The bath brush of claim 2, wherein said fasteners are restrictively engaged within the first trough and the second trough.

5. The bath brush of claim 1, wherein the at least one hole includes a plurality of holes.

6. The bath brush of claim 1, wherein the at least one fastener includes a plurality of fasteners.

7. The bath brush of claim 5, wherein the at least one mesh includes a plurality of meshes, each mesh is mounted on each fastener respectively.

8. The bath brush of claim 1, wherein the at least one hole extends completely through the stem.

9. A bath brush comprising:

a stem having at least one hole, a first trough, and a second trough corresponding to the first trough;

at least one fastener corresponding to the at least one hole, including a hat with a hollow part and a pair of plastic parts disposed on the hat; and at least one mesh disposed on the stem by passing through the hollow part of the fastener and then inserting the fastener into the at least one hole of the stem.

10. The bath brush of claim 9, wherein the at least one hole is positioned within the first trough and the second trough.

11. The bath brush of claim 9, wherein the at least one hole includes a plurality of holes.

12. The bath brush of claim 9, wherein the at least one fastener includes a plurality of fasteners.

13. The bath brush of claim 12, wherein the at least one mesh includes a plurality of meshes, each mesh is mounted on each fastener respectively.

14. The bath brush of claim 9, wherein said fasteners are restrictively engaged within the first trough and the second trough.

15. The bath brush of claim 9, wherein the at least one hole is positioned on a longitudinal side of the stem.

16. A bath brush comprising:

a stem having a plurality of holes;

a plurality of fasteners corresponding to the plurality of holes, each of the fasteners including a hat with a hollow part and a pair of plastic parts disposed on the hat; and a plurality of meshes disposed on the stem by respectively passing through the hollow parts of the plurality of fasteners and then inserting the fasteners into the plurality of holes of the stem.

17. The bath brush of claim 16, wherein the stem has a first trough and a second trough corresponding to the first trough.

18. The bath brush of claim 17, wherein the plurality of holes are positioned within the first trough and the second trough.

19. The bath brush of claim 17, wherein said fasteners are restrictively engaged within the first trough and the second trough.

20. The bath brush of claim 16, wherein the plurality of holes are positioned on a longitudinal side of the stem.

* * * * *